US006599164B1

(12) United States Patent
Gerwitz et al.

(10) Patent No.: US 6,599,164 B1
(45) Date of Patent: Jul. 29, 2003

(54) INTERACTIVE TOY FOUNTAIN

(75) Inventors: Christina N. Gerwitz, Lakewood, OH (US); Larry C. Dick, Sugar Bush Knolls, OH (US); Thomas E. Fish, Wickliffe, OH (US); James N. Fitzsimmons, Aurora, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/494,602

(22) Filed: Jan. 31, 2000

(51) Int. Cl.[7] ..... A63H 29/08
(52) U.S. Cl. ..... 446/168
(58) Field of Search ..... 446/168, 171, 446/176, 199, 211, 179; 40/406, 407, 409, 439, 477

(56) References Cited

U.S. PATENT DOCUMENTS

| | | | | |
|---|---|---|---|---|
| 1,492,105 A | | 4/1924 | Reynolds et al. | |
| 2,388,483 A | | 11/1945 | Hess | |
| 2,752,725 A | * | 7/1956 | Unsworth | 446/168 |
| 2,785,895 A | | 3/1957 | Neveling, Sr. | |
| 3,887,182 A | * | 6/1975 | Breslow | 273/450 |
| 4,175,665 A | * | 11/1979 | Dogliotti | 446/168 |
| 4,205,785 A | * | 6/1980 | Stanley | 239/17 |
| D255,920 S | | 7/1980 | Antonell | |
| 4,550,876 A | | 11/1985 | Kulesza et al. | |
| 4,932,917 A | * | 6/1990 | Klitsner | 446/168 |
| 4,946,164 A | | 8/1990 | Fuller et al. | |
| 4,993,986 A | * | 2/1991 | Bloomfield | 446/179 |
| 5,009,192 A | | 4/1991 | Burman | |
| 5,022,588 A | * | 6/1991 | Haase | 239/211 |
| 5,050,801 A | | 9/1991 | Ferrari | |
| 5,111,993 A | | 5/1992 | Baker | |
| 5,224,652 A | * | 7/1993 | Kessler | 239/211 |
| 5,277,645 A | * | 1/1994 | Kelley et al. | 446/268 |
| 5,312,285 A | * | 5/1994 | Rieber et al. | 446/168 |
| 5,322,717 A | | 6/1994 | Killian | |
| 5,375,828 A | | 12/1994 | Shikami | |
| 5,403,018 A | | 4/1995 | Sejnowski et al. | |
| 5,426,877 A | | 6/1995 | Lin | |
| 5,426,878 A | | 6/1995 | Branson | |
| 5,458,093 A | | 10/1995 | MacMillan | |
| 5,501,179 A | | 3/1996 | Cory | |
| 5,528,220 A | | 6/1996 | Woods | |
| 5,794,364 A | | 8/1998 | Richmond | |
| 5,944,575 A | * | 8/1999 | Tolnay | 446/168 |

OTHER PUBLICATIONS

Water T–Ball, instruction sheet and advertisement, Ohio Art Company, 1997 and 1998.
Splatter Up, Care and Instructions, Wet Enterprises and Buddy L Inc., 1993.
Ball Spoutin' Fountain, copy of packaging, Mattel Inc., 1996.

* cited by examiner

*Primary Examiner*—Jacob K. Ackun
*Assistant Examiner*—Faye Francis
(74) *Attorney, Agent, or Firm*—Piper Rudnick

(57) ABSTRACT

A fountain toy comprising a channel defining first and second openings and a conduit adjacent to the channel defining a downward delay path. The conduit includes a first opening near the top of the channel and a second opening communicating with the second opening of the channel. An intake portal for transferring liquid from an external source is coupled to a nozzle located adjacent to the base of the channel. When the external source provides liquid to the intake portal, the liquid travels through the nozzle and flows upward and out of the channel in a laminar flow. A spherical game piece is placed by a user in the first opening of the conduit, where it travels through the conduit. When the game piece reaches the bottom of the conduit, the game piece enters the channel and is carried by the stream of liquid through the channel and out of the fountain to be suspended in the air.

27 Claims, 5 Drawing Sheets

INTERACTIVE TOY FOUNTAIN

TECHNICAL FIELD

This invention relates generally to interactive toy fountains. More particularly, this invention relates to an interactive toy fountain where a game piece interacts with the flow of liquid in the fountain.

BACKGROUND OF THE INVENTION

Toy sprinklers and fountains are well known in the toy industry. In particular, there are a number of sprinklers that are constructed such that a jet of water can suspend a small object, such as a ball, in the air. For example, U.S. Pat. No. 4,946,164 is directed to such a baseball-like game where a ball is suspended in the air prior to being struck by a bat.

Although fountains such as these can be enjoyable for young users, the fountains in the prior art can be quite cumbersome to use and are not suitable for small children. Furthermore, most conventional sprinklers are often not very interactive in that the users do not have much involvement in the use of this fountain. Finally, many fountains are for display purposes only and are not used by individuals as a game or other form of enjoyment.

SUMMARY OF THE INVENTION

This invention provides a fountain toy comprising a channel with first and second openings and a conduit defining a downward delay path. The conduit includes a first opening that is close to the top of the channel and a second opening that communicates with the second opening of the channel. At the base of the toy is an intake portal which will accept pressurized liquid from an external source, such as a hose, and transfer it through the channel via a nozzle. A game piece, such as a ball with a diameter smaller than that of the channel and conduit, is placed in the first opening of the conduit. The game piece proceeds to travel down the conduit until it reaches the conduit opening that communicates with the second channel opening. As the game piece enters the channel, it comes into contact with the stream of liquid that has been forced through the nozzle from the intake portal. This stream of liquid forces the game piece through the channel and out of the toy fountain. Preferably, the game piece is then suspended in the air by the stream of liquid, which preferably has laminar flow characteristics.

This invention also provides for a toy fountain with a vertical channel and a helically-shaped conduit which is wrapped around the channel. Inside the conduit is a track upon which a game piece, such as a ball, will travel as it passes through the conduit. A portion of this track is partially offset from the remainder of the track. As the game piece moves from the offset part to the remainder of the track, the change in dimension and orientation of the track surface causes the game piece to slow down. The outer surface of the channel includes a series of ribs which also operate to reduce the velocity of the game piece as it moves through the conduit. After the game piece has passed the offset portion of the track and the ribs, its velocity increases as it travels through the helical conduit and into the channel. Where a user has introduced more than one game piece into the conduit, the additional delays caused by the helical offsets and the ribs help space apart the game pieces from each other, preventing jamming. Once the game piece enters the channel, it is carried by a stream of liquid through the channel and out of the fountain toy.

It is therefore a technical advantage of the present invention to provide a toy fountain that includes a downward delay path that is coupled to a vertically oriented channel, whereby a game piece will pass through the delay path and into the channel, where it is then carried by a stream of water out of the channel.

A further advantage of the invention is to provide a toy fountain with the downward delay path for a ball to travel upon before it is carried by a stream of water out of the fountain, whereby the delay path includes an offset portion for slowing down the ball before it enters a vertically-oriented channel.

It is still another advantage of the invention to provide a toy fountain where a game piece is inserted in a helically-shaped conduit and passes into a channel, whereby the ball is carried by a stream of fluid out of the channel and is suspended in the air.

Further advantages and features of the present invention will be apparent from the following specifications and claims once considered in connection with the accompanying drawings illustrating the preferred embodiment of the present invention. Like characters identify like parts in the drawings.

DETAILED DESCRIPTION OF THE ILLUSTRATED EMBODIMENT

Figure 1:
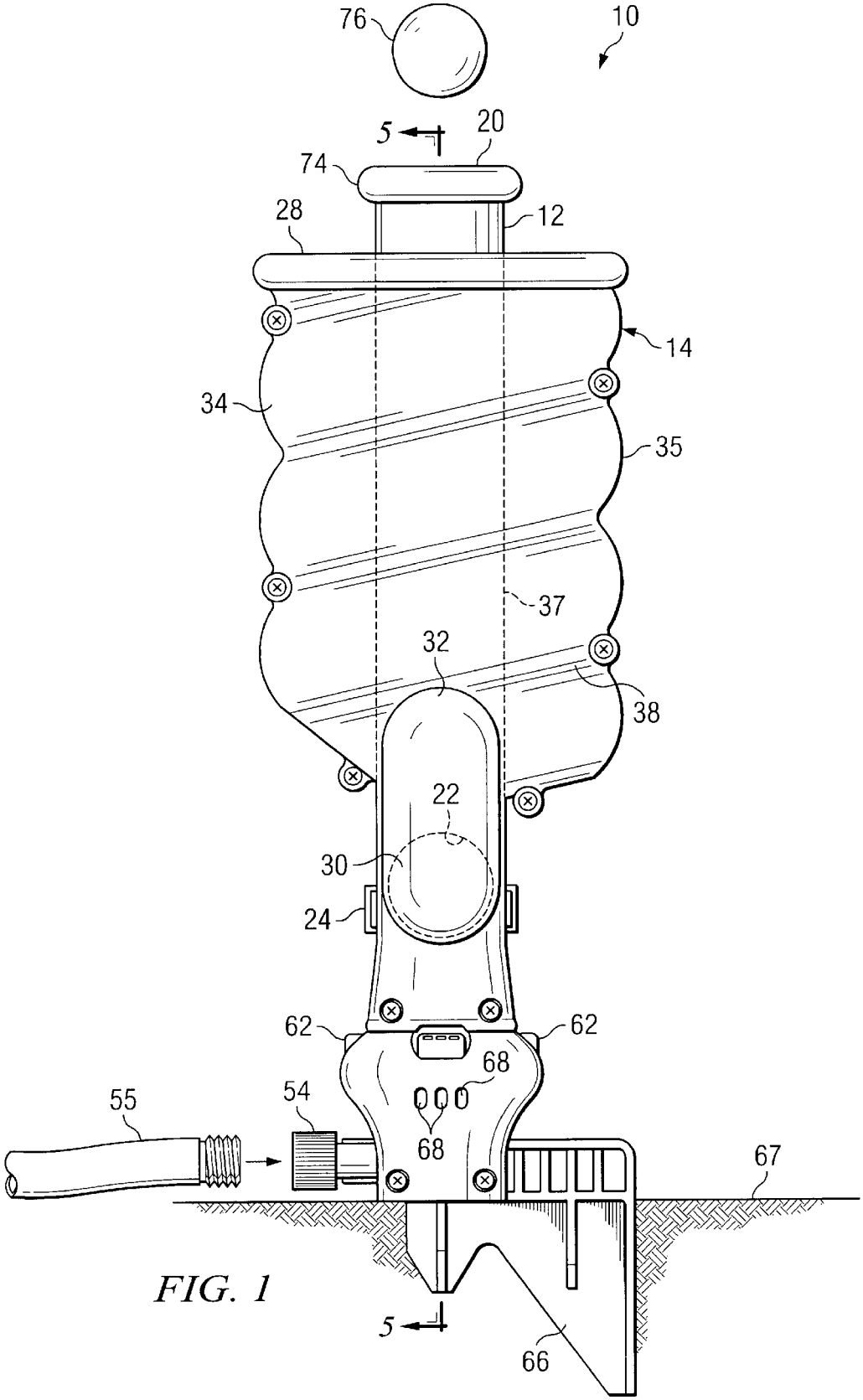
FIG. 1 is an elevational front view of a toy fountain according to the invention.
Figure 3:
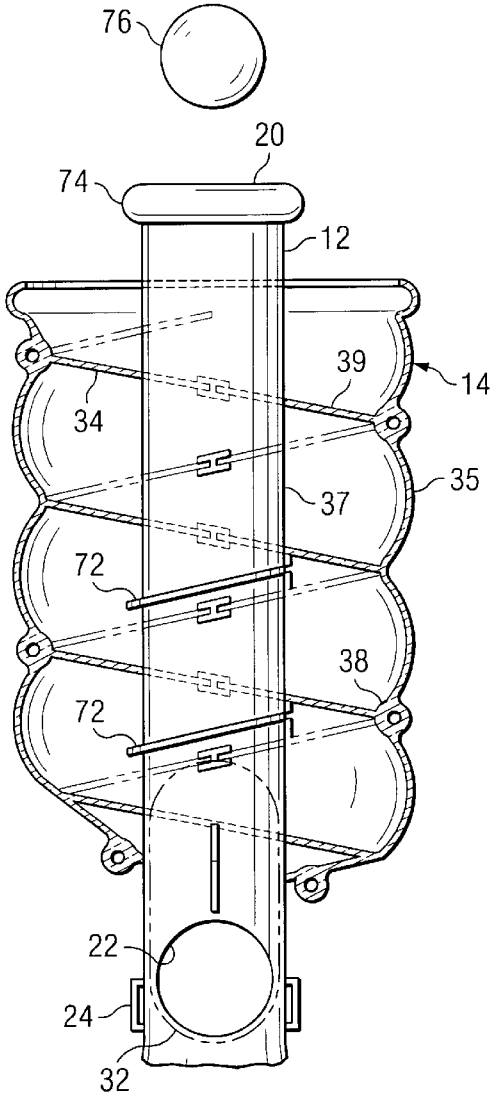
FIG. 3 is a sectional side view of the channel and conduit taken substantially along line 3—3 of FIG. 2.
Figure 5:
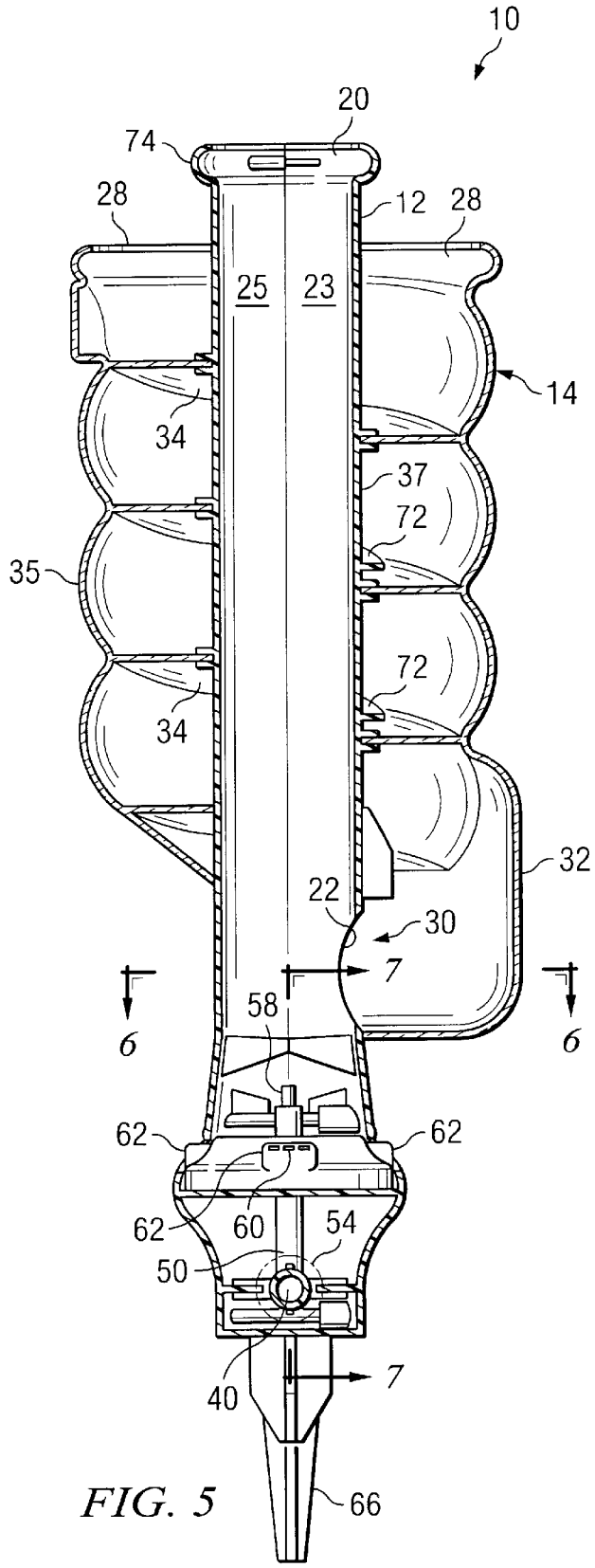
FIG. 5 is a sectional side view of the toy, taken substantially along line 5—5 of FIG. 1.
Figure 6:
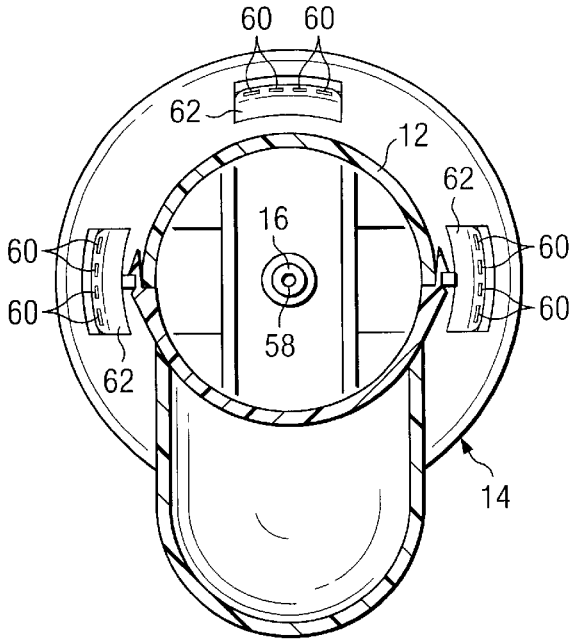
FIG. 6 is a sectional view of the toy, taken substantially along line 6—6 of FIG. 5.

FIG. 1 shows a front elevational view of the toy fountain shown generally at 10. The fountain 10 includes a channel 12 surrounded by a conduit 14. In an exemplary form of the invention, the conduit 14 is helically-shaped and surrounds a substantial portion of the channel 12. As can be seen in FIGS. 3 & 5, the channel 12 has a first, upper, exit opening 20 and a second, lower, entrance opening 22. Inside the lower portion of the channel 12 is a nozzle 16 which is coupled to a liquid intake portal 18. The first opening 20 is located at the top portion of the channel 12 while the second opening 22 is located near the bottom portion thereof and off to one side. Preferably, the channel 12 is cylindrically shaped, straight and is substantially vertical relative to the ground. In a preferred embodiment of the invention, the channel is formed of two pieces 23 and 25 that are joined together by clips 24 (FIG. 1). It is also possible, however, for the channel to be formed as one piece or to be formed as multiple pieces and connected in some other manner.

Figure 2:
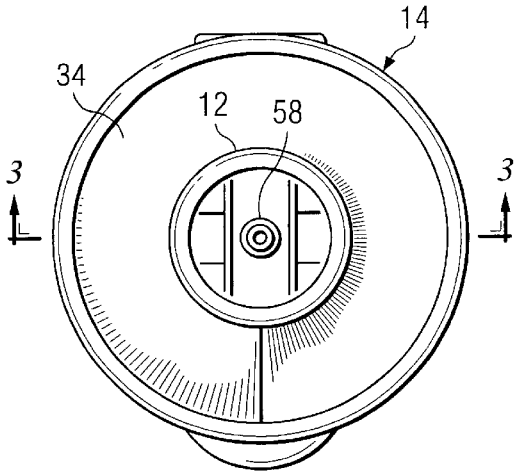
FIG. 2 is a top view of the toy fountain of FIG. 1.
Figure 4:
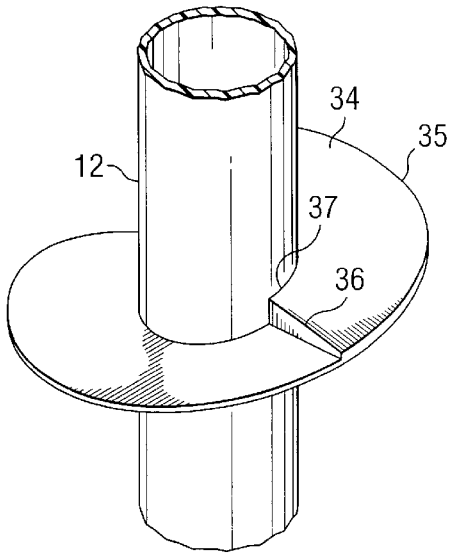
FIG. 4 is a sectional side view of the helical conduit that forms the delay path for a game piece.

As can be seen in FIGS. 2, 3 & 5, the helical conduit 14 has two openings, an upper opening 28 and a lower opening 30. The first opening 28 is located at the top portion of the conduit 14 and is preferably located near the opening 20 of the channel 12. The second opening 30 of the conduit 14 is located at the bottom of the conduit 14 and communicates directly with the second opening 22 of the channel 12. In a preferred embodiment of the invention, the second opening 30 of the conduit 14 is contained by a conduit exit portal 32 that is located at the base of the helical conduit 14. The conduit 14 includes a series of curved ridges 38 that together form the shape of the conduit 14 as a helical tube. On the inside of the conduit 14 is a guide track 34 with a flat surface 39. As shown in FIG. 4, a portion 36 of the guide track 34 is offset from the remainder of the track 34. In a preferred embodiment of the invention, this offset is produced by altering the angle of the guide track 34 between the outer edge 35 of the conduit and the outer surface 37 of the channel 12. This forms a vertical step in an otherwise helical and continuous loop. In an exemplary embodiment of the invention, the entire conduit 14 is made of a transparent plastic material so that the users may observe the progress of the game piece or game pieces, although translucent or opaque materials are also possible.

Figure 7:
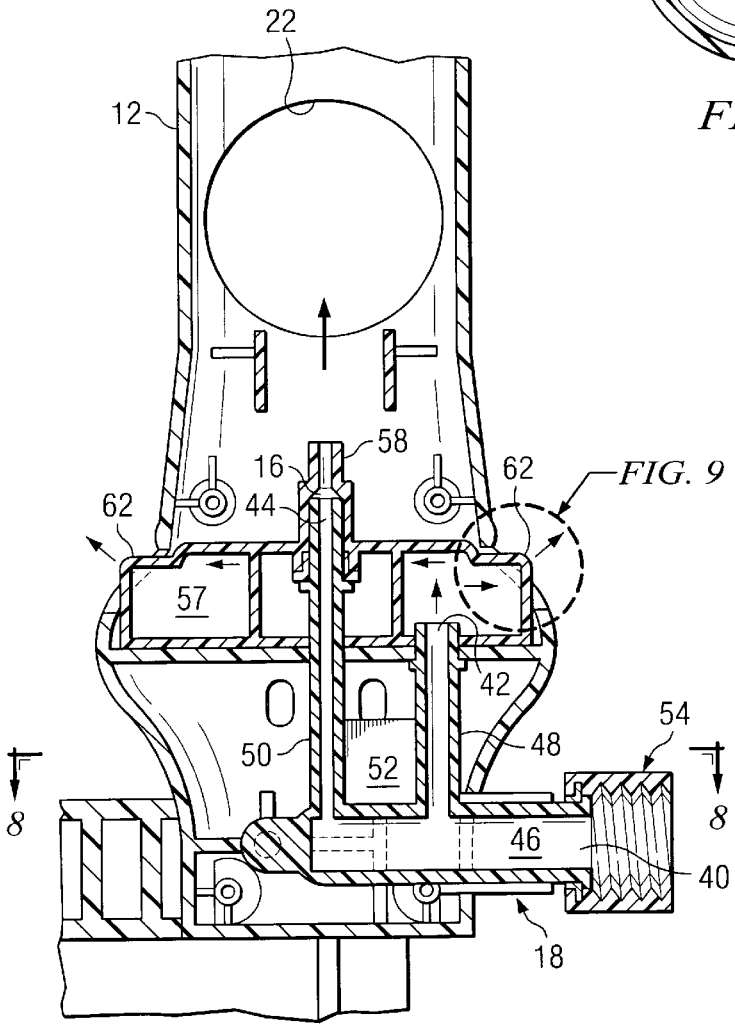
FIG. 7 is a sectional view of a liquid intake portal and lower channel taken substantially along line 7—7 of FIG. 5.

As seen in FIG. 7, the intake portal 18 includes a entrance opening 40 and a pair of exit openings 42 and 44. The entrance opening 40 is formed by a standard female hose connector 54 that is used to attach the fountain 10 to a standard garden hose 55 or other conduit for transferring liquid to the fountain 10. The entrance opening 40 leads to a horizontal passageway 46. The horizontal passageway 46 is coupled to and communicates with first and second vertical passageways 48 and 50. Each of the vertical passageways 48 and 50 terminates with a respective portal exit opening 42 or 44. In one embodiment of the invention, the two vertical passageways 48 and 50 are coupled to each other by a stabilizing piece or web 52 which is used for stabilizing the two passageways 48 and 50 and also results in an easier method of manufacture.

Figure 8:
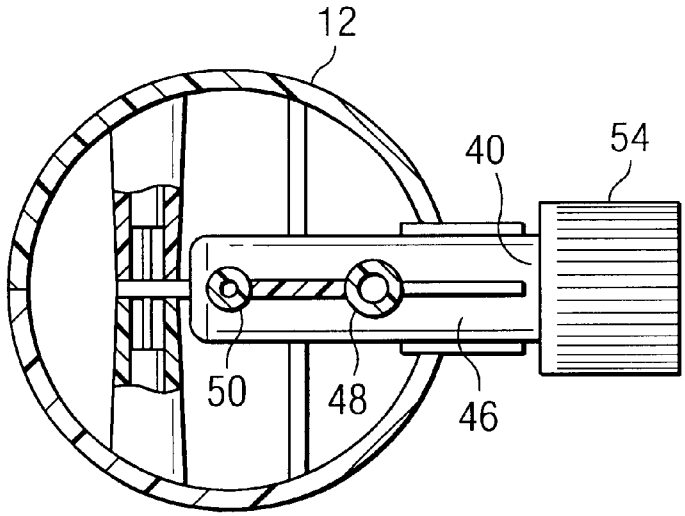
FIG. 8 is a sectional side view of the intake portal taken substantially along line 8—8 of FIG. 7.

As can be seen in FIG. 8, the second exit opening 44 coincides with a nozzle 16 and includes a spout 58. The nozzle 16 communicates with the second portal exit opening 44 such that liquid will flow directly into the spout 58. The spout 58 is centered within the base of the channel 12. A secondary entrance chamber 57 communicates with the first portal exit opening 42.

Figure 9:
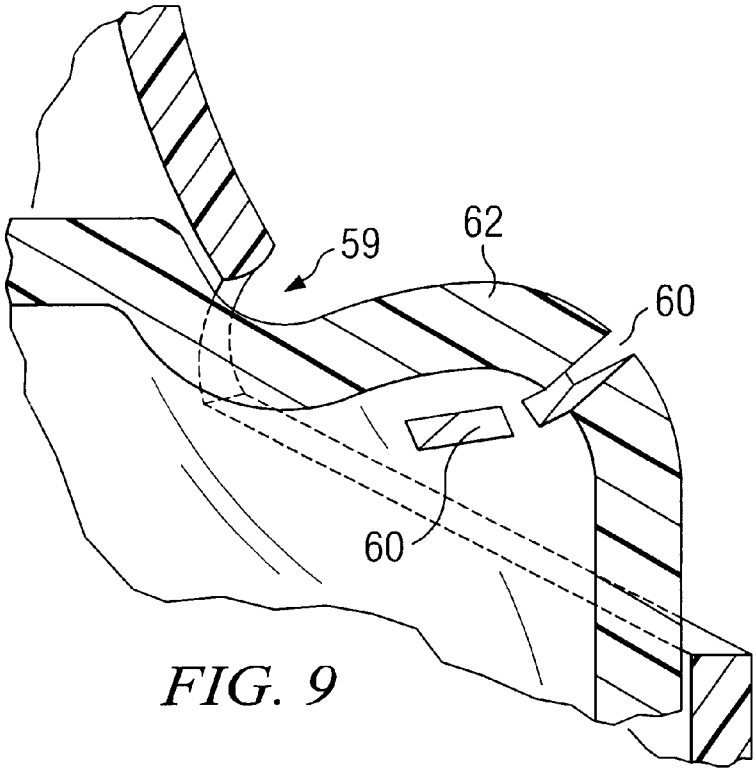
FIG. 9 is a sectional view of a sprinkler slot ridge taken substantially along line 9—9 of FIG. 7.

As shown in FIG. 9, at the top of and near the outside of the secondary entrance chamber 57 are a series of slot ridges 62, each of which include a plurality of sprinkler slots 60. It is through these slots 60 that liquid will flow after it passes through the secondary entrance chamber 57. The sprinkler slot ridges 62 are positioned such that they pass through a series of corresponding channel holes 59 located at the base on the channel 12 and thus into the environment, creating nonaxial fountain streams of liquid. Also at the base of the channel 12 are a series of openings 68 that can be used to remove excess liquids from inside the channel 12. In one embodiment of the invention, there are a series of four sprinkler slot ridges 62 and each ridge 62 includes four sprinkler slots 60 of varying dimensions. Additionally, an embodiment of the invention includes three further openings 68 on each side on the base of the channel 12.

As can be seen in FIGS. 1 & 5, the channel 12 also includes an integrally molded stake 66 for use in securing the fountain 10 to the ground 67. In order to secure the fountain 10, the user simply pushes down on the fountain 10 such that stake 66 is forced into the ground 67. Although an integral stake 66 is used to secure the toy 10 in a preferred embodiment of the invention, other methods are also possible.

The operation of the fountain 10 is generally as follows. A hose 55 is attached to the intake portal 18 by the hose connector 54. When the water is turned on, water will flow through the intake portal 18 and enter the first and second vertical passageways 48 and 50. The water that passes through the first vertical passageway 48 will exit through the first portal exit opening 42 and enter the secondary entrance chamber 57. The water will then pass through the sprinkler slots 60 which are located along the slot ridges 62. This will result in a series of jets of water exiting from the sides of the fountain 10.

At the same time, the water that passes through the second vertical passageway 50 will exit through the second portal exit opening 54 and enter the nozzle 16, where it will be forced through the nozzle spout 58. The nozzle spout 58 will create a laminar flow in the jet of water, creating a compressed stream of liquid that will be forced through the channel 12. In order to create a laminar flow, the dimensions of the spout 58 must be carefully selected. In order to create the laminar flow, it has been determined that the length of the spout 58 should be at least ten times the inner diameter of the spout 58.

While water is flowing through the toy 10, a game piece 76 is placed at the top of the conduit 14 in the first opening 28. Preferably, the game piece 76 is spheroidal in shape and in a most preferred embodiment of the invention, the game piece 76 is a spherical ball. In order to operate satisfactorily, it is important that the game piece 76 have a smaller diameter than both the inner diameter of the channel 12 and the distance between the edge of the conduit 14 and the outer surface of 37 of the channel 12. If the game piece 76 is too large, it will likely get stuck in either the channel 12 or conduit 14 and the fountain 10 will not function properly.

Once the game piece 76 is placed within the conduit 14, it will proceed to roll down the guide track 34, following the helical path. At the top of the guide track 34 is the offset portion 36 that is used for slowing down the velocity of the game piece 76. As explained earlier, the offset portion of 36 has an angle between the outer edge 35 of the conduit 14 and the outer surface 37 to channel 12 that is different from the angle of the next portion of the guide track 34, created by a step. As the game piece 76 moves from the offset portion 36 to the next portion of the guide track 14, the piece 76 will be temporarily suspended such that it is not in contact with the lower surface of the guide track 34. At this time, the effective diameter of the guide track 34 is increased, causing the game piece 76 to be temporarily in contact with both the edge 35 of the conduit and the outer surface 37 of the channel 12. This causes the velocity of the game piece to be temporarily reduced. As the game piece continues to move across the guide track 34, however, the effective diameter increases, allowing more room for the game piece 76 to pass through the conduit 14. This results in the velocity of the game piece 76 increasing once it has completely passed the offset portion 36. The advantage of having this delay mechanism 36 is that if the user inserts multiple game pieces 76 into the conduit 14 at the same time, the offset portion 36 will cause each game piece 76 to slow down as it crosses from the offset portion 36 to the next portion of the guide track 34. This will increase the distance between consecutively placed game pieces 76 as they pass through the conduit 14, reducing the risk of the game pieces 76 jamming inside the conduit 14. This also insures that the stream of water exiting the channel 12 continues in laminar flow while carrying only one game piece 76. It is also possible to have multiple offset portions 36 located throughout the conduit 14. In one embodiment of the invention, there exists one offset portion 36 for every complete circle formed by the guide track 34 in the conduit 14.

Additionally, the outside surface 37 of the channel 12 includes a series of ribs 72 that are located slightly above and generally follow the path of the guide track 34 of the conduit 14. As the game piece 78 follows the guide track 34, it comes into contact with one of the ribs 72. The ribs 72 have the effect of slightly elevating the game piece 76 above the guide track 34. The ribs 72 will cause the ball to roll on circles of the ball's surface other than its greatest circumference, such that the same rotational speed of the ball will produce a smaller forward translation in the ball's position. This also reduces the effective angle between the outer surface 37 of the channel and the outer edge 35 of the conduit. This results in the game piece 76 slowing down relative to its previous velocity. This also helps separate multiple game pieces 76 when they are placed on after another in the conduit 14.

As previously discussed, once the game piece 76 is placed in the conduit 14, it travels down the guide track 34. In a preferred embodiment of the invention, the entire guide track is transparent so that the users may watch the game piece 76 travel through the conduit 14. Once the game piece 76 reaches the bottom of the conduit 14, it enters the conduit exit portal 32 and exits the second opening of 30 of the conduit 14. Simultaneously, the game piece 76 enters the second opening 22 of the channel 12, where it then comes into contact with the stream of water that has exited from the nozzle spout 58 in a compressed stream. Due to the relatively light weight of the game piece 76, the water stream proceeds to "carry" the game piece 76 in an upward direction. The stream will remain relatively narrow and will push the game piece 76 straight through the top edge of 74 of the channel 12. As the stream of water maintains its laminar flow, the game piece 76 will be carried well beyond the channel 12. At the uppermost point of the stream where the water begins to fall back to the ground, the game piece 76 will be suspended in the air by the water stream. In a preferred embodiment of the invention, the game piece 76 can be suspended in this location for a significant amount of time. In order for the game piece 76 to be suspended, however, it is important that the fountain toy 10 be oriented substantially vertical to the ground. This is accomplished by pushing the protrusion 66 into the ground and altering the direction such that the channel 12 is substantially vertical to the ground.

While several preferred embodiments have been shown and described, it is understood that changes and modifications can be made to the invention without departing from the invention's broader aspects. For example, it is possible for the fountain toy to have a variety of sprinkler spouts of slots located in a variety of positions throughout the fountain. Additionally, it is possible for the conduit to have a variety of shapes other than that of a helix. Thus, it is apparent that alternative embodiments are available to most skilled and development art. Therefore, the present invention is not limited to the described and illustrated embodiment but only by the scope and spirit of independent and dependent claims.

What is claimed is:

1. A fountain toy, comprising:

a vertical channel defining an upper exit opening and a lower entrance opening;

a helical conduit surrounding the channel, the helical conduit including an upper entrance opening surrounding the upper exit opening of the channel and a lower exit opening communicating with the lower entrance opening of the channel, the helical conduit having an unobstructed path extending between the upper entrance opening and the lower exit opening;

an intake portal for transferring liquid from an external source;

a jet port disposed in the channel to be remote from the upper exit opening of the channel, the jet port communicating with the intake portal and emitting a jet of liquid that travels through the lower entrance opening of the channel and toward the upper exit opening of the channel; and a game piece having a spheroidal shape which can pass through the helical conduit, the lower entrance opening of the channel and the channel, wherein the game piece may be dropped in the helical conduct, whereupon the game piece travels through the conduit and into the channel, whereby the jet of the liquid forces the game piece up through and out of the channel.

2. The fountain toy of claim 1, wherein at least a portion of the conduit defines a helical pathway that forms a spiraling path around the channel.

3. The fountain toy of claim 1, wherein the jet port includes an elongated tube terminating in an outlet, the tube being disposed coaxially of the channel, a length of the tube being at least ten times a diameter of the tube such that the jet of fluid is laminar.

4. The fountain toy of claim 3, wherein the game piece, when forced out of the fountain, is suspended in the air by the jet of liquid.

5. The fountain toy of claim 1, further comprising a protrusion extending from the channel for coupling the fountain to a flat surface.

6. The fountain toy of claim 1, wherein liquid exits the jet port, travels through the channel, and exits the first channel opening in a direction substantially perpendicular to the ground.

7. The fountain toy of claim 1, wherein the game piece has a spherical shape.

8. The fountain toy of claim 1, further comprising reductions means for reducing the rate of speed at which the ball travels through the conduit.

9. The fountain toy of claim 8, wherein the reduction means comprise at least one longitudinally disposed rib protruding into the conduit.

10. The fountain toy of claim 1, further comprising a plurality of vents running from the intake portal, whereby liquid from the intake portal flows out of the vents.

11. The fountain toy of claim 1, wherein the conduit is transparent such that the game piece is viewable when the game piece is inside the conduit.

12. A water toy, comprising:

a ball having a diameter;

a vertical channel having an upper exit opening at one end, a lower entrance opening near the other end, and an inner diameter, the inner diameter of the channel being larger than the diameter of the ball;

a helical conduit coupled to the channel and having a first end, second end and a diameter larger than the diameter of the ball, the first end of the conduit including an opening surrounding the upper exit opening of the channel, the second end including an opening communicating with the lower entrance opening of the channel, the helical conduit having an unobstructed path extending between the upper entrance opening and the lower exit opening such that the ball, when placed in the conduit, promptly passes through the conduit and into the channel, the helical conduit includes a track upon which the ball travels before it enters the channel, wherein a portion of the track is vertically offset from the remainder of the track such that the velocity of the ball is reduced as it travels across the offset track portion;

a nozzle located at the other end of the channel beneath the lower entrance opening of the channel; and an intake portal coupled to the nozzle for receiving water from an external source and providing water to the nozzle, wherein when the ball travels through the helical conduit, the ball enters the channel and is carried by the water exiting the nozzle such that it is forced out of the channel.

13. The water toy of claim 12, wherein water exits the nozzle and travels through the channel such that a laminar flow is produced.

14. The water toy of claim 13, wherein the length of the nozzle is at least ten times as large as the diameter of the nozzle.

15. The water toy of claim 12, further comprising means for securing the toy to the ground.

16. The water toy of claim 12, further comprising a series of vents coupled to the intake portal for ejecting water from the toy.

17. The water toy of claim 12, wherein the offset portion of the track is located near the first end of the conduit.

18. The water toy of claim 12, wherein the helical conduit is formed around the channel.

19. The water toy of claim 12, wherein the helical conduit is transparent.

20. The water toy of claim 12, further comprising a longitudinally disposed rib protruding from the channel into the conduit for reducing the velocity of the ball.

21. The water toy of claim 20, further comprising a second game piece, wherein when the first and second game pieces are placed consecutively in the conduit, the longitudinally disposed rib causes the distance between the first game piece and the second game piece to increase.

22. A fountain toy, comprising:

a vertically-oriented tube having an entrance portion at the bottom end thereof and an exit portion at the top end thereof;

a conduit adjacent to the tube and having an entrance portion at the top end thereof and an exit portion at the bottom end thereof, the exit portion communicating with the entrance portion of the tube;

an intake portal coupled to the tube for providing liquid to the tube;

a spheroidal game piece that is placed in the conduit, wherein when the game piece travels through the exit portion of the conduit and enters the tube, the liquid from the intake portal forces the game piece through the tube; and a plurality of vents coupled to the intake portal, whereby fluid will flow through the vents in a plurality of directions.

23. The fountain toy of claim 22, further comprising means for securing the toy to a level surface such that the tube is oriented substantially perpendicular to the level surface.

24. The fountain toy of claim 22, further comprising a nozzle coupled to the tube for directing fluid from the intake portal through the tube.

25. The fountain toy of claim 22, wherein the length of the nozzle is at least ten times the size of the inner diameter of the nozzle.

26. The fountain toy of claim 25, wherein a laminar flow of fluid is produced as fluid flows through the exit portion of the tube.

27. The fountain toy of claim 22, wherein a portion of the helical passageway is offset at an angle from the remainder of the passageway, wherein the game piece, when traveling across the offset portion, will accelerate at a lower rate than it accelerates across the remainder of the passageway.

* * * * *